US009239140B2

(12) United States Patent
Hikmet et al.

(10) Patent No.: US 9,239,140 B2
(45) Date of Patent: Jan. 19, 2016

(54) LIGHT-EMITTING ARRANGEMENT WITH ADAPTED WAVELENGTH CONVERTER

(71) Applicant: KONINKLIJKE PHILIPS N.V., Eindhoven (NL)

(72) Inventors: Rifat Ata Mustafa Hikmet, Eindhoven (NL); Albert Bijlsma, Best (NL); Ties Van Bommel, Horst (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/354,417

(22) PCT Filed: Oct. 10, 2012

(86) PCT No.: PCT/IB2012/055474

§ 371 (c)(1),
(2) Date: Apr. 25, 2014

(87) PCT Pub. No.: WO2013/061193

PCT Pub. Date: May 2, 2013

(65) Prior Publication Data

US 2014/0301063 A1 Oct. 9, 2014

Related U.S. Application Data

(60) Provisional application No. 61/551,520, filed on Oct. 26, 2011.

(51) Int. Cl.
*F21K 99/00* (2010.01)
*F21V 13/08* (2006.01)
(Continued)

(52) U.S. Cl.
CPC ... *F21K 9/56* (2013.01); *F21V 9/16* (2013.01); *F21V 13/02* (2013.01); *F21V 13/08* (2013.01); *F21Y 2101/02* (2013.01); *F21Y 2103/003* (2013.01)

(58) Field of Classification Search
CPC ..... F21V 3/0463; F21V 3/0481; F21V 7/005; F21V 13/08; F21V 13/10
USPC ..... 362/84, 222, 230, 242, 249.02; 40/552, 40/557, 564
See application file for complete search history.

(56) References Cited

U.S. PATENT DOCUMENTS 7,192,161 B1 * 3/2007 Cleaver et al. ..... 362/260
7,665,865 B1 2/2010 Hulse et al.
(Continued)

FOREIGN PATENT DOCUMENTS

EP 2293355 A2 3/2011
JP 2005136224 A 5/2005
(Continued)

*Primary Examiner* — Alan Cariaso
*Assistant Examiner* — Colin Cattanach
(74) *Attorney, Agent, or Firm* — Yuliya Mathis

(57) ABSTRACT

A light-emitting arrangement (100) comprising a reflective member (101) having a reflective surface (102) on which at least one LED is arranged is disclosed. A wavelength converting member (104) comprising a first wavelength converting material, adapted to convert light of a first wavelength into light of a second wavelength, is arranged on the reflective member. The converting member has a top face (105) oriented parallel to the reflective surface, and has a first side face (106) and a second side face (107) that are each arranged between the top face and the reflective member on a respective side of the LED(s). The top face is arranged at a vertical distance (V1) from a light-emitting surface (108) of the LED(s). By adapting the properties, dimensions and/or orientation of the faces of the wavelength converting member according to the invention, a desirable light distribution from the light-emitting arrangement is achieved.

13 Claims, 6 Drawing Sheets

(51) Int. Cl.

| | |
|---|---|
| ***F21V 9/16*** | (2006.01) |
| ***F21V 13/02*** | (2006.01) |
| *F21Y 103/00* | (2006.01) |
| *F21Y 101/02* | (2006.01) |

(56) References Cited

U.S. PATENT DOCUMENTS

| | | | | |
|---|---|---|---|---|
| 7,963,666 | B2 | 6/2011 | Leung et al. | |
| 7,972,030 | B2 | 7/2011 | Li | |
| 2006/0072314 | A1* | 4/2006 | Rains | 362/231 |
| 2006/0291246 | A1* | 12/2006 | Hattori et al. | 362/614 |
| 2007/0297179 | A1* | 12/2007 | Leung et al. | 362/296 |
| 2008/0054281 | A1* | 3/2008 | Narendran et al. | 257/98 |
| 2008/0094829 | A1* | 4/2008 | Narendran et al. | 362/231 |
| 2008/0310158 | A1* | 12/2008 | Harbers et al. | 362/240 |
| 2009/0103293 | A1* | 4/2009 | Harbers et al. | 362/231 |
| 2010/0172120 | A1* | 7/2010 | Wegh et al. | 362/84 |
| 2010/0172121 | A1* | 7/2010 | Hikmet et al. | 362/84 |
| 2010/0188837 | A1* | 7/2010 | Van Bommel et al. | 362/84 |
| 2011/0182068 | A1 | 7/2011 | Harbers et al. | |
| 2011/0286214 | A1* | 11/2011 | Quinlan et al. | 362/235 |
| 2012/0002396 | A1* | 1/2012 | Tseng et al. | 362/84 |
| 2012/0087124 | A1* | 4/2012 | Ravillisetty et al. | 362/235 |
| 2012/0106125 | A1* | 5/2012 | Yokotani et al. | 362/84 |
| 2012/0250320 | A1* | 10/2012 | Harbers et al. | 362/247 |
| 2012/0257386 | A1* | 10/2012 | Harbers et al. | 362/235 |
| 2014/0247579 | A1* | 9/2014 | Hikmet et al. | 362/84 |

FOREIGN PATENT DOCUMENTS

| | | | |
|---|---|---|---|
| JP | 2007266356 | A | 10/2007 |
| JP | 2010514209 | A | 4/2010 |
| JP | 2010530125 | A | 9/2010 |

* cited by examiner

LIGHT-EMITTING ARRANGEMENT WITH ADAPTED WAVELENGTH CONVERTER

FIELD OF THE INVENTION

The present invention relates to a LED-based light-emitting arrangement.

BACKGROUND OF THE INVENTION

Conventional lighting systems including fluorescent lamps have been used for decades but are expected to be replaced by light-emitting diode (LED)-based luminaries in the future. Typically, such LED-based luminaries include a plurality of LEDs.

White light may be obtained from an LED using a blue LED and a wavelength converting material, also known as phosphor, which absorbs part of the blue light emitted by the LED and reemits light of longer wavelength(s). For reasons of efficacy it is preferable to have the wavelength material arranged at a distance from the LED, in a so-called remote configuration.

In the field of lighting for interior and exterior, there is an increasing need for lighting systems having a specific design and function. The purpose of lighting may be the creation of a general illumination or to focus the light on certain areas or objects. For example, in an office environment it is often desirable to provide direct lighting for workspaces as well as indirect lighting for general illumination. Hence it would be desirable to provide a lighting system which has a specific light distribution.

For this purpose, to obtain a desired beam shape, combinations of refractive and or diffractive optical elements have been used. However, such optical elements are usually expensive and may decrease the system efficiency due to optical losses.

Hence, there is still a need in the art to provide an improved lighting system which has a specific light distribution.

SUMMARY OF THE INVENTION

In view of the above-mentioned and other drawbacks of the prior art, a general object of the present invention is to provide a LED-based light-emitting arrangement having a specific light distribution without the need of expensive optics.

According to a first aspect of the invention, this and other objects are achieved by a light-emitting arrangement, comprising a reflective member having a reflective surface; at least one light-emitting diode (LED) arranged on the reflective surface of the reflective member, the at least one light-emitting diode is adapted to emit light of a first wavelength; a wavelength converting member comprising a first wavelength converting material adapted to convert light of a first wavelength into light of a second wavelength, the wavelength converting member arranged on the reflective member and has a top face oriented parallel to a reflective surface of the reflective member, and has a first side face and a second side face each arranged between the top face and the reflective member on a respective side of the at least one light-emitting diode.

The present invention is based on the realization that by employing a wavelength converting member having a top face and a first and second side face in a LED-based light-emitting arrangement a specific light distribution therefrom can be a achieved by adapting the properties of the wavelength converting member, for example, by adapting properties such as size of the faces, and/or the reflectivity thereof.

The terms "side face" and "top face" should, in the context of this application, be understood as sub-members or portions of the wavelength converting member having a volume, which sub-members typically have a substantially planar shape. Hence, the first side face may also be referred to as a first sub-member, the second side face as a second sub-member, and the top face as a top sub-member. The properties, e.g. size and reflectivity, of each sub-member may typically be adapted as desired before being assembled into the wavelength converting member.

In embodiments of the invention, the light-emitting arrangement further comprises a redirecting member arranged in the path of light from the at least one light-emitting diode to the wavelength converting member, to redirect light emitted by the at least one light-emitting diode towards the wavelength converting member.

The redirecting member may typically comprise at least one of a diffusing optical element, a refractive optical element, a diffractive optical element and a reflective optical element. Thus, the redirecting may redirect light emitted from the at least one light-emitting diode to achieve a uniform spatial spread of the light over the inner surfaces of the faces of the wavelength converting member and thereby reducing color angle of the output light.

The wavelength converting member is typically configured to convert a first portion of the received light, from a first wavelength to a second wavelength, and to transmit a second portion of received light, and thereby achieving a desirable spectral composition of the output light from the light-emitting arrangement. Furthermore, light emitted from the wavelength converting may be further reflected by the reflective member and thereby achieving a light output from the light-emitting arrangement having a double asymmetric beam shape.

By adapting the dimension of the first and second faces and the top face of the wavelength converting member, the light distribution from the wavelength converting member may be controlled. For example, the ratio between a width Y1 of the first or second side face and a width X1 of the top face may be in the range of from 100:1 to 1:100, such as from 50:1 to 1:50.

In embodiment of the invention, each of said first and second side face may be arranged at a lateral distance from the at least one light-emitting diode.

In embodiments of the invention, each of the first and second side faces of the wavelength converting member may be oriented at angle $\alpha$ in the range of 30-150°, such as 50-120°, for example 80-100°, with respect to the reflective surface of the reflective member.

Thus, by adapting the orientation of the first and second sides the light distribution from the wavelength converting member may be further controlled.

In embodiments of the invention the first side face may be adapted to have a first reflectivity R1, and said second side face may be adapted to have a second reflectivity R2, and the top face may be adapted to have a third reflectivity R3, wherein at least one of R1, R2 and R3 may be different from another one of R1, R2 and R3. For example, all of R1, R2 and R3 may be different from each other. Thereby, the light distribution from the light-emitting arrangement may be further controlled.

According to embodiments of the invention, the light-emitting arrangement may further comprise a first and a second planar specular reflector arranged on the reflective member on a respective side of the wavelength converting member, to reflect light from the wavelength converting member, thereby the light distribution from the light-emitting arrangement may be further controlled.

In embodiments of the invention, the redirecting member may be disposed on a light-emitting surface of the at least one light-emitting diode. Alternatively, the redirecting member and the at least one light-emitting diode may be mutually spaced apart. Thereby, the distribution of light from the at least one light-emitting diode towards the wavelength converting member may be adapted as desired.

According to embodiments of the invention, the redirecting member may be in thermal contact with at least one light-emitting diode on the reflective member, and with at least one of the first side face, the second side face and the top face of the wavelength converting member. Thus, heat may be conducted from the wavelength converting member to the reflective member, as the reflective member is typically in thermal connection with a heat sink for thermal management purposes.

In embodiments of the invention, the light-emitting arrangement may comprise a plurality of light-emitting diodes arranged along a longitudinal length Z of the reflective member.

In embodiments of the invention, the first and second faces extend along a longitudinal direction Z of the reflective member.

In embodiments of the invention, the wavelength converting member may comprise a third side face and a fourth side face arranged between the top face and the reflective member on a respective side of the at least one light-emitting diode, the third and fourth faces extending from the first face to the second face along a transverse direction X of the reflective member. The third and the fourth faces may typically be reflective, and/or may comprise a first wavelength converting material.

In embodiments of the invention, the light-emitting arrangement may advantageously be comprised in any suitable sort of luminaires, such as, for example, LED-based TL lamp.

BRIEF DESCRIPTION OF THE DRAWINGS

These and other aspects of the present invention will now be described in more detail, with reference to the appended drawings showing example embodiments of the invention, wherein.

DESCRIPTION OF EXAMPLE EMBODIMENTS OF THE PRESENT INVENTION

In the following description, the present invention is described with reference to a LED-based light-emitting arrangement have a specific light distribution output.

Figure 1:
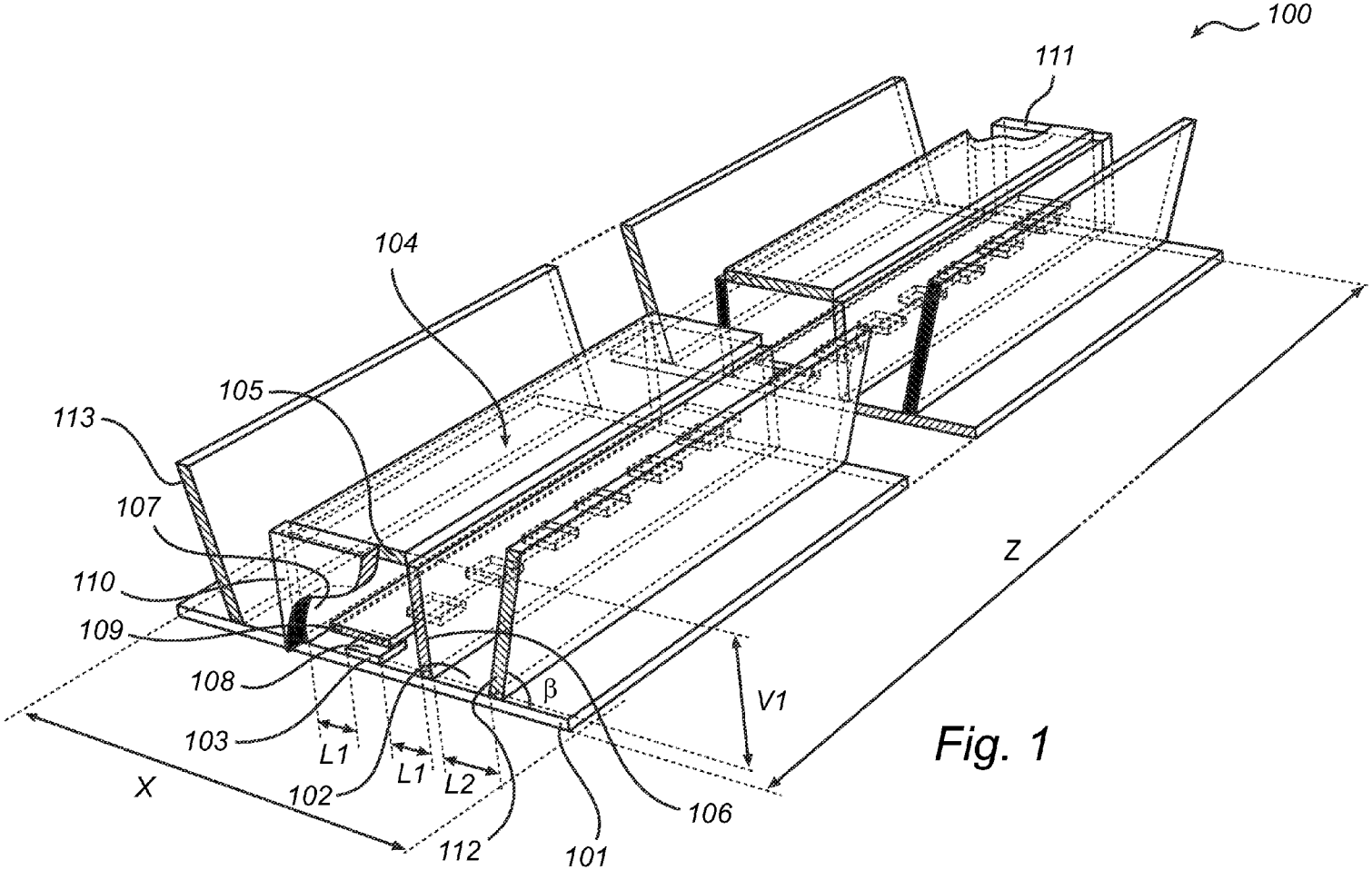
FIG. 1 shows a perspective view of an embodiment of the light-emitting arrangement according to the present invention.

FIG. 1 shows a perspective view of an embodiment of the light-emitting arrangement 100 according to the present invention comprising a reflective member 101 with a reflective surface 102; and a plurality of LEDs 103 arranged on the reflective surface 102 of the reflective member along a longitudinal direction Z thereof, which LEDs 103 are adapted to emit light of a first wavelength. The light-emitting arrangement further comprises a wavelength converting member 104 comprising a first wavelength converting material adapted to convert light of the first wavelength into light of a second wavelength. As depicted in FIG. 1, the wavelength converting member 104 is arranged on the reflective surface 102 of the reflective member in the path of light from the LEDs 103. The wavelength converting member has a top face 105, and a first 106 and a second 107 side face arranged between the top face 105 and the reflective member 101, wherein the first 106 and second 107 side faces and the top face 105 extend in the longitudinal direction Z of the reflective member 101. The top face 105 is oriented parallel to the reflective surface 102 of the reflective member and arranged at a vertical distance V1 from a light emitting-surface 108 of the LEDs. The first 106 and second 107 side faces are each arranged on a respective side of the LEDs 103 at a lateral distance L1 therefrom.

It should be noted that each of the side 106, 107 and top 105 faces of the wavelength converting member should be understood as sub-members or portions of the wavelength converting member 104, which sub-members have a volume and typically a substantially planar shape. The each sub-member 105, 106, 107 may be provided separately and thus adapted to have desirable properties, e.g. desirable size, reflectivity, content of wavelength converting material, before being assembled into the wavelength converting member 104.

As shown in FIG. 1, the light-emitting arrangement 100 may comprise a redirecting member 109 arranged in the path of light from the LEDs 103 to redirect light emitted by the LEDs towards the surrounding faces 105, 106, 107 of the wavelength converting member 104 and thereby ensuring a uniform distribution of light from the LEDs 103.

Typically, the wavelength converting member 104 is configured to convert only a portion of the light of the first wavelength, by for example adapting the concentration of the wavelength converting material and/or thickness wavelength converting member 104, and thus part of the light of the first wavelength is transmitted through the wavelength converting, thereby a desirable color output may be achieved. Furthermore, a portion of the light from the light converting member 104 is further reflected by the reflective member 101 and thereby achieving a light distribution from the light-emitting arrangement 100 having a double asymmetric beam shape (or "batwing" shape) (see e.g. FIG. 4*b*).

The reflective member typically comprises a printed circuit board (PCB) on which the LEDs are arranged and which PCB has an at least partly reflective top surface 102, for example, a PCB which is at least partly coated with a reflective material. Further, the PCB may typically be in thermal contact with a heat sink (not shown) in order to conduct heat from the LEDs 103 and the wavelength converting member 104 (see below).

In embodiments of the invention, the first side face 106 has a first reflectivity R1, and the second side face 107 has a second reflectivity R2, and said top face 105 has a third reflectivity R3. By adapting the reflectivity R1, R2, R3 of the faces 106, 107, 105, the light distribution from the light-emitting arrangement 100 can be controlled. R1, R2 and R3 may independently correspond to any given reflectivity in the range of 4-100%. For example, the reflectivity R3 of the top face 105 may be adapted to have a relatively high reflectivity of e.g. 80% (i.e. reflecting 80% of incident light), whereas the reflectivity R1 and R2 of the first 106 and second 107 side faces, respectively, may have a lower reflectivity of e.g. 50%, resulting in a specific light distribution from the light-emitting arrangement 100 as, in this example, more light will be transmitted through the first 106 and second 107 side faces than through the top face 105.

In order to provide a desired reflectivity, the wavelength converting member 104 may comprise scattering particles. Typically, the different faces or sub-members, i.e. the side face 106, 107 and top 105 faces of the wavelength converting member 104 may comprise scattering particles and/or reflective layer(s). Typically, different faces 105, 106, 107 of the wavelength converting member may comprise different contents or different concentrations of scattering particles. Thus, the reflectivity of the side 106, 107 and top 105 faces of the wavelength converting member may be adapted by, for example, adapting the content of scattering particles, e.g. $Al_2O_3$ and/or $TiO_2$, and/or the scattering properties of the wavelength converting material in each of the sides 105, 106, 107 of the wavelength converting element, and/or by coating a surface of the side 106, 107 and top 105 faces with one or more reflective layer(s).

As shown in FIG. 1 the light-emitting arrangement may further comprise a third 110 and a fourth 111 side face arranged between the top face 105 of the wavelength converting member and the reflective member 101. The third side face 110 and fourth side face 111 are arranged on opposite sides of the plurality of LEDs 103 on the reflective member 101, extending along the transverse direction X of the reflective member 101 from the first side face 106 to the second 107 side face of the wavelength converting member. The plurality of LEDs 103 is thereby enclosed by the side faces 106, 107, 110, 111 and the top face 105 of the wavelength converting member 104 on the reflective member 101.

The third 110 and the fourth 111 side faces of the wavelength converting member may comprise a first wavelength converting material. However, depending on the application of the light-emitting arrangement 100, the third 110 and the fourth 111 side faces of the wavelength converting member may be reflective faces which need not comprise a first wavelength converting material, for example, the third 110 and fourth 111 side faces may only comprise reflective particles, such as e.g. $Al_2O_3$ or $TiO_2$, and/or a reflective layer, or the third 110 and fourth 111 side faces may be specular reflectors. The third 110 and the fourth 111 side faces should, like the first 106 and second 107 side faces and top face 105, be understood as sub-members or portions of the wavelength converting member 104, which sub-members have a volume and typically a substantially planar shape.

Figure 2A:
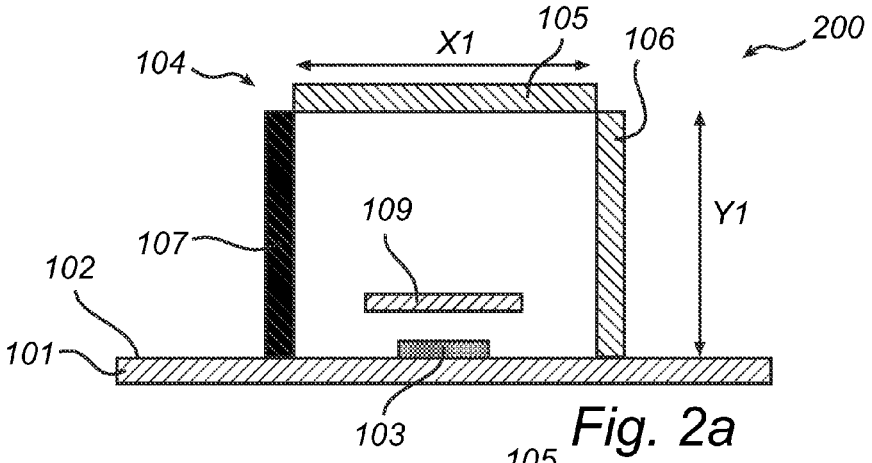
FIGS. 2*a-i* show cross-sectional side views of embodiments of the light-emitting arrangement according to the invention.
Figure 2B:
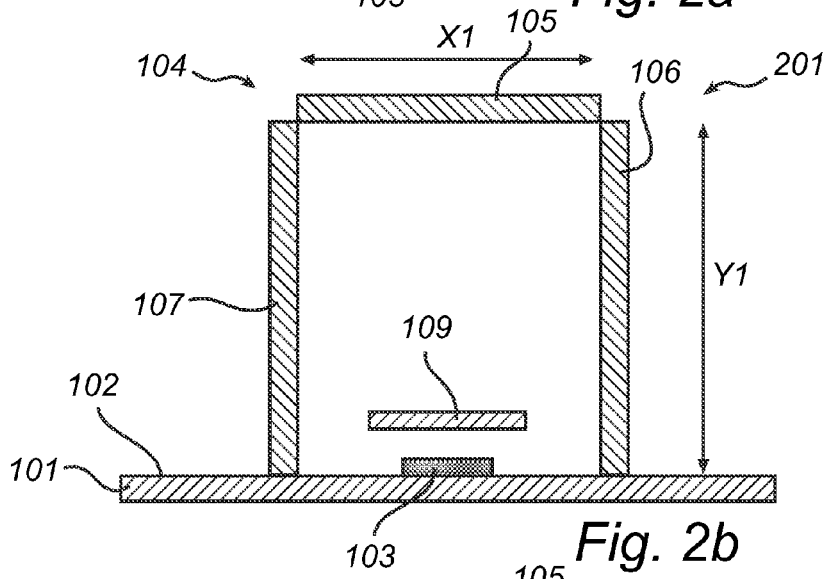

Furthermore, as shown in FIG. 1, the light-emitting arrangement 100 may further comprise a first specular reflector 112 and a second specular reflector 113, each arranged on the reflective surface 102 of the reflective member on a respective side of the wavelength converting member 104 and extending along the longitudinal direction Z of the reflective member 101, to reflect and outcouple light emitted from the wavelength converting member 104. Each of the first 112 and second 113 specular reflector is arranged at a lateral distance L2 from the respective first 106 and second side 107 faces of the wavelength converting member. Furthermore, each of the first 112 and the second 113 specular reflector is oriented at an angle β, typically in the range of 1-90°, with respect to the reflective surface 102 of the reflective member. Thereby, the light distribution achieved through the wavelength converting member 104 can be further refined as desired. FIGS. 2*a-i* show cross-sectional side views of embodiments of the light-emitting arrangement 200, 201,202, 203, 204, 205, 206, 207, 208 according to the invention. As illustrated in FIGS. 2*a-b*, the ratio between the width Y1 of the first 106 and the second 107 side faces of the wavelength converting member 104 and the width X1 of the top face 105 thereof can be adapted in order to achieve a desired light distribution from the wavelength converting member 104. Typically, the ratio between the width Y1 of each of the first 106 and the second side 107 faces and the width X1 of the top face 105 may be in the range of from 100:1 to 1:100, such as 50:1 to 1:50, for example, being 1:1 as shown in FIG. 2*a*, or being 2:1 as shown in FIG. 2*b*. Typically, the width Y1 of the first 106 or the second 107 side faces and the width X1 of the top face 105 may be in the range of from 3 mm to 10 cm.

Figure 2C:
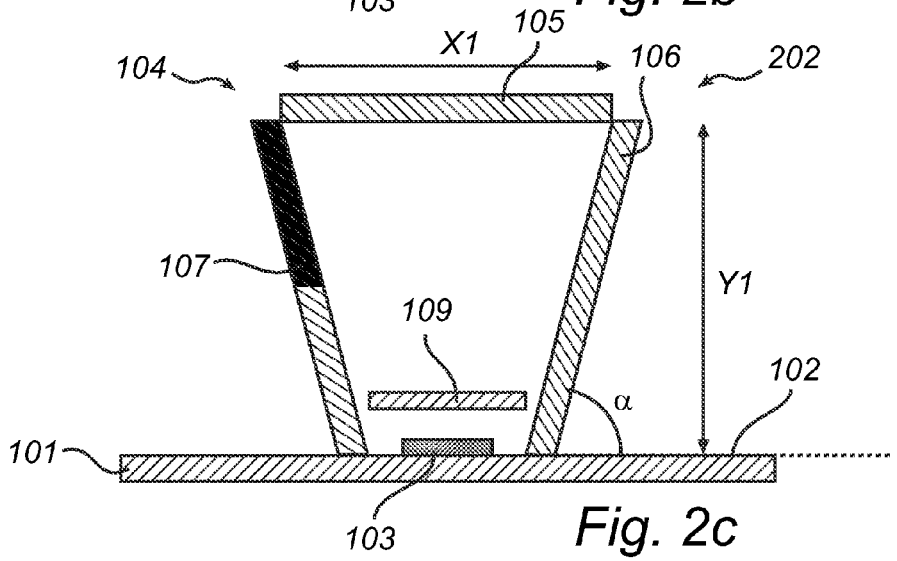
Figure 2D:
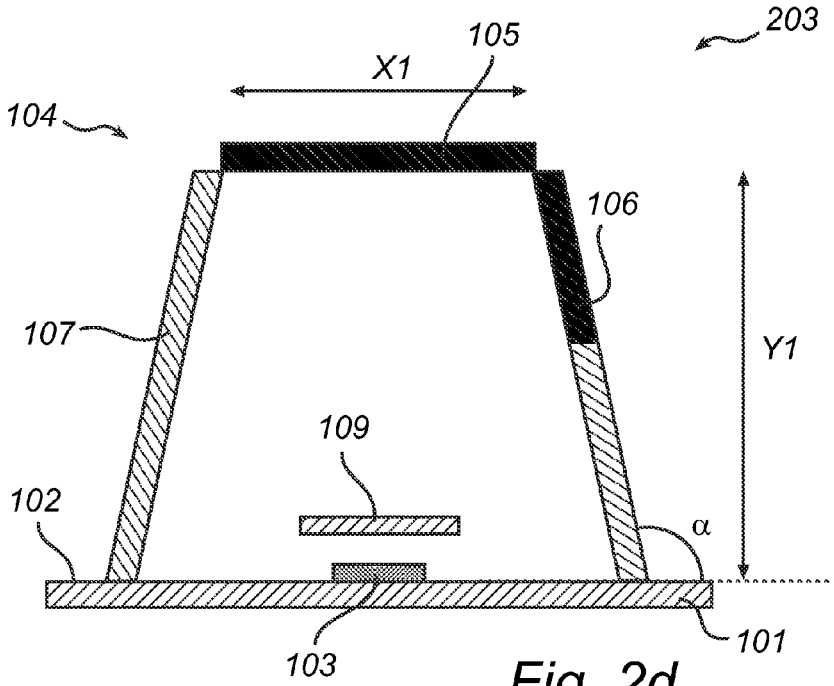

The light distribution of the light output from the light-emitting arrangement 202, 203 may also be adapted by orienting the first 106 and second 107 side faces of the wavelength converting member at an angle α in the range of 30-150°, with respect to the reflective surface 102 of the reflective member 101. For example, the angle α may be in the range of 70-90° as illustrated in FIG. 2*c*, however, the angle α may typically be in the range of 90-120° as illustrated in FIG. 2*d*.

Figure 2E:
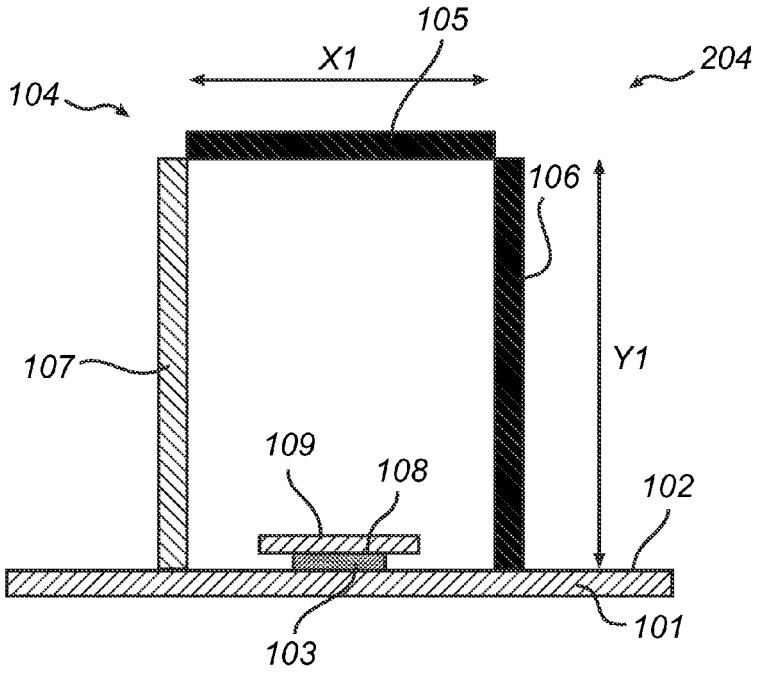
Figure 2F:
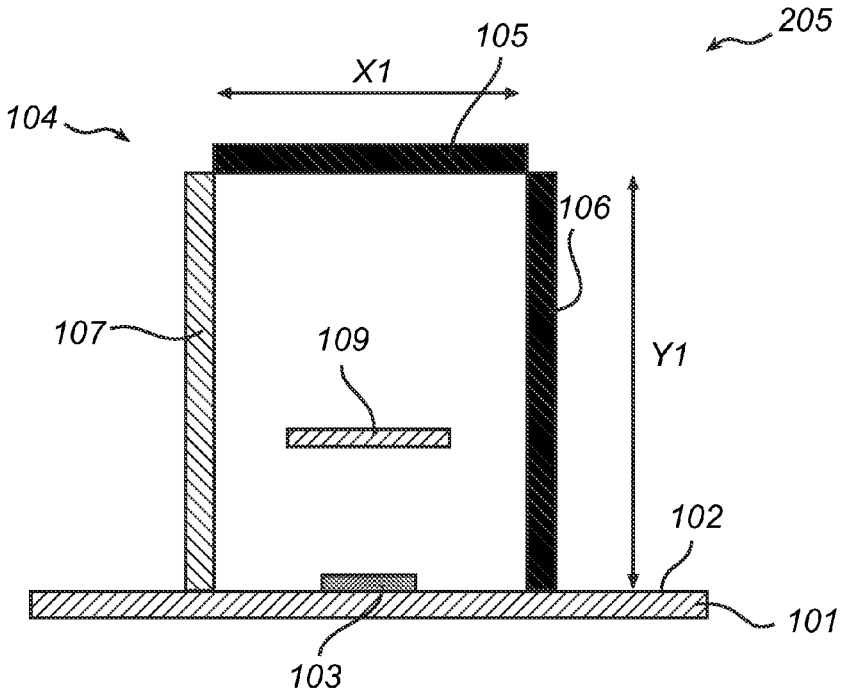

Furthermore, as shown in FIGS. 2*e-i* many different configurations of the redirecting member 109 comprised in the light-emitting arrangement 204, 205, 206, 207, 208 are possible, and thereby the distribution of the light from the at least one LED 103 towards the wavelength converting member 104 may be adapted. For example, as shown in FIG. 2*e*, the redirecting member 109 can be disposed on a light-emitting surface 108 of the at least one LED 103. Alternatively, as shown in FIG. 2*f* the redirecting member 109 and the at least one LED 103 may be mutually spaced apart.

Figure 2G:
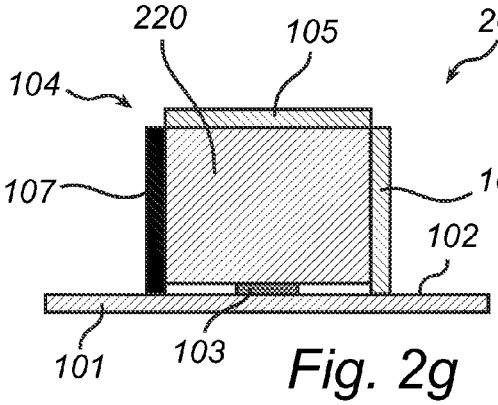
Figure 2H:
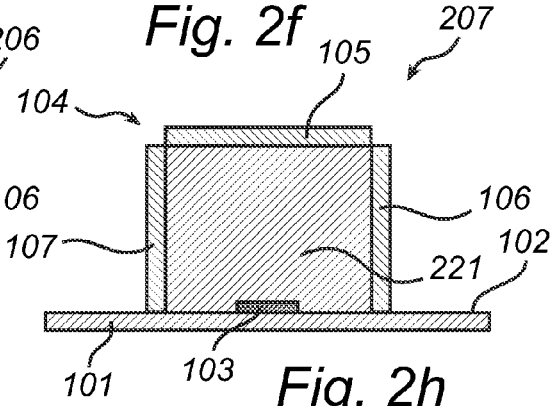
Figure 2I:
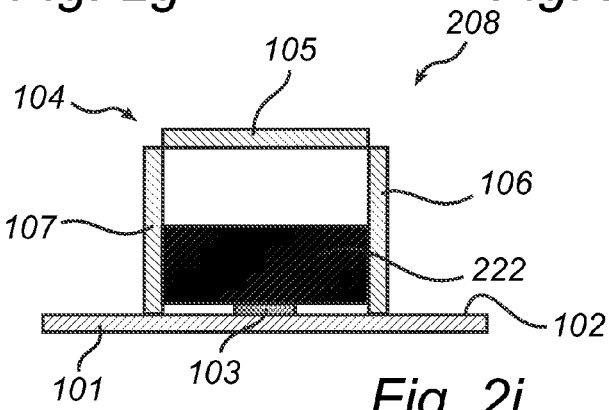

According to embodiments of the invention, the redirecting member 109 may comprise at least one of a diffusing optical element, a refractive optical element, a diffractive optical element and a reflective optical element. For example, in embodiments of the invention, the redirecting member 109 may comprise a diffusing optical element in the form of a diffusing film which is disposed on a light-emitting surface 108 of the at least one LED 102 (see e.g. FIG. 2*e*). In embodiments of the invention, as shown in FIGS. 2*g-i*, the redirecting member 220, 221, 222 can advantageously be in thermal contact with the LED 103 on the reflective member 101 and at least one of the first side face 106, second side face 107 and the top face 105 of the wavelength converting member 104. As discussed above, the reflective member 101, and thus also the LED 103, is typically in thermal contact with a heat sink (not shown), and so by arranging the redirecting member 220, 221, 222 in thermal contact with the wavelength converting member 104, heat can be conducted away from the wavelength converting member 104 comprising the wavelength converting material which is usually heat sensitive.

Figure 3A:
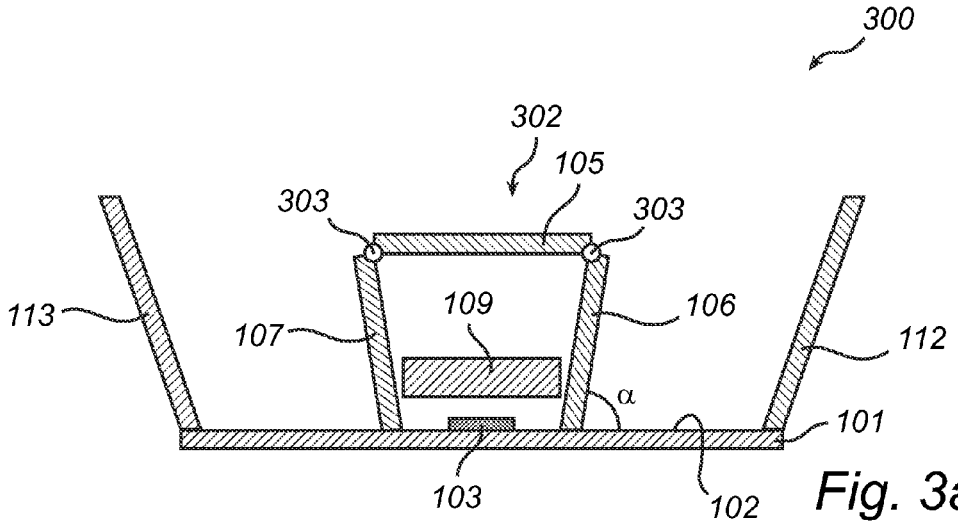
FIGS. 3*a-b* show cross-sectional side views of embodiments of the light-emitting arrangement according to the invention.
Figure 3B:
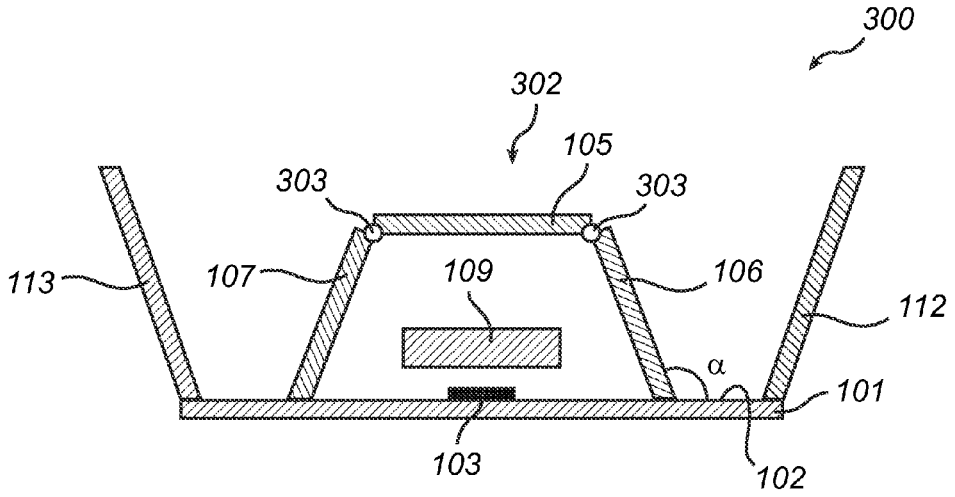

In an embodiment of the invention, shown in FIGS. 3*a-b*, the light-emitting arrangement 300 can comprise a wavelength converting member 302 wherein the first 106 and second side 107 faces are attached to the top face 105 through a flexible joint 303. Thus, the orientation of the first 106 and the second 107 side faces with respect to the reflective surface 102 of the reflective member 101 is adjustable upon installation of the light-emitting arrangement 300 and thereby the orientation may be adapted to achieve a desirable light distribution to fit with a given application use of the light-emitting arrangement 300. FIGS. 3*a-b* schematically illustrate such configuration of the wavelength converting member 302, wherein the orientation of the first 106 and the second 107 side faces with respect to the reflective surface 102 of the reflective member 101 is adjusted from an angle α less than 90°, as shown in FIG. 3*a*, to angle α larger than 90°, as shown in FIG. 3*b*.

According to embodiments of the present invention, the wavelength converting member 104, 302, 404 may comprise a second wavelength converting material typically configured to convert light of a first wavelength into light of a third wavelength. Alternatively, the second wavelength converting material may be configured to convert light of a wavelength different from the first wavelength into light of the second wavelength. Thereby, the spectral composition of the output light can be adapted as desired.

The third wavelength is typically different from the first wavelength and the second wavelength. Typically, the first wavelength may be in the range of from 380 to 520 nm, such as, for example, from 440 to 480 nm.

In embodiments of the invention the first and/or second wavelength converting material may comprise an organic luminescent molecule such as a perylene derivative.

In embodiments of the invention the first and/or second wavelength converting material may comprise an inorganic luminescent material such as cerium doped yttrium aluminum garnet (YAG) or lutetium aluminum garnet (LuAG).

Examples of inorganic luminescent material include, for example, Cerium (Ce) doped Yttrium Aluminum Garnet (YAG) in a molecular ratio of YAG:Ce of 2.1 or 3.3, and/or Lutetium Aluminum Garnet (LuAG, $Lu_3Al_5O_{12}$), and or red inorganic phosphor such as BSSN ($(BaSr)_2Si_5NN:Fu^2$) and/or ECAS ($Ca_{0.99}ALSiN_3:Eu_{0.01}$).

Examples of organic wavelength converting material include, for example, BASF Lumogen® F240 (orange), BASF Lumogen® F305 (red), BASF Lumogen® F083 (yellow), BASF Lumogen® F170 (yellow), BASF Lumogen® F650 (blue) and/or BASF Lumogen® F570 (violet), or combinations thereof.

In embodiments of the invention the first and/or second wavelength converting material may comprise quantum dots. Quantum dots are small crystals of semiconducting material generally having a width or diameter of only a few nanometers. When excited by incident light, a quantum dot emits light of a color determined by the size and material of the crystal. Light of a particular color can therefore be produced by adapting the size of the dots.

Most known quantum dots with emission in the visible range are based on cadmium selenide (CdSe) with shell such as cadmium sulfide (CdS) and zinc sulfide (ZnS). Cadmium free quantum dots such as indium phosphode (InP), and copper indium sulfide ($CuInS_2$) and/or silver indium sulfide ($AgInS_2$) can also be used. Quantum dots show very narrow emission band and thus they show saturated colors. Furthermore the emission color can easily be tuned by adapting the size of the quantum dots. Any type of quantum dot known in the art may be used in the present invention, provided that it has the appropriate wavelength conversion characteristics. However, it may be preferred for reasons of environmental safety and concern to use cadmium-free quantum dots or at least quantum dots having a very low cadmium content.

In embodiments of the invention, the light-emitting arrangement may advantageously be comprised in any suitable sort of luminaries, such as, for example, LED-based TL lamp.

Additionally, variations to the disclosed embodiments can be understood and effected by the skilled person in practicing the claimed invention, from a study of the drawings, the disclosure, and the appended claims. For example, the light-emitting arrangement may not include a first and a second specular reflector, but rather, such reflectors may instead be provided in the particular luminaire in which the light-emitting arrangement is being used. Further, the light-emitting arrangement may not comprise a third side face and a fourth side face as described above, but rather, the light-emitting arrangement may instead comprise corresponding sides which extend from the first and the second specular reflector in the transverse direction X of the reflective member. Alternatively, the light-emitting arrangement may not include a third side face and a fourth side face or variations thereof, as described above, but rather, corresponding sides may be provided in the the particular luminaire in which the light-emitting arrangement is being used.

EXAMPLES

Figure 4A:
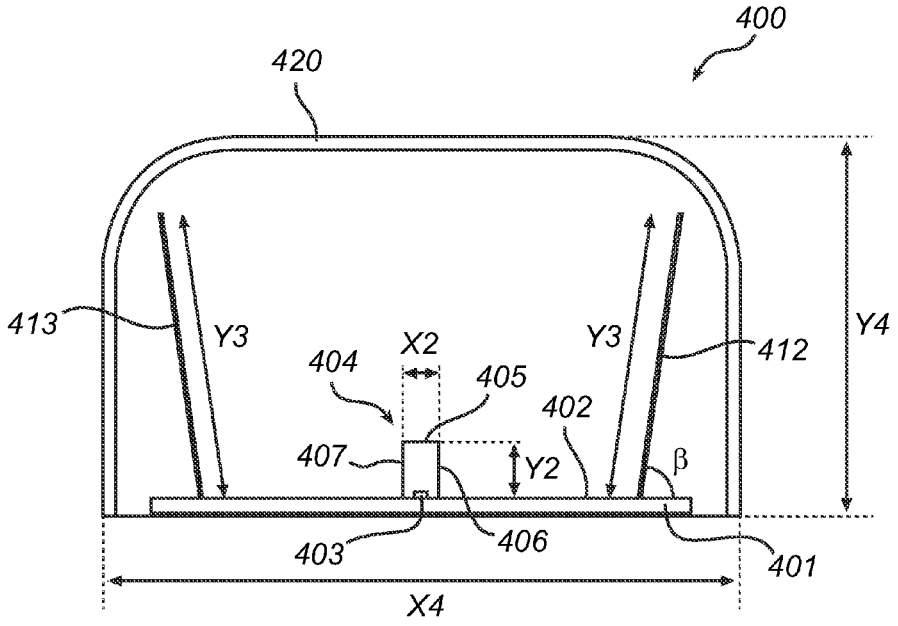
FIG. 4 shows (a) a cross-sectional side view of an embodiment of the light-emitting arrangement according to the invention and (b) the corresponding polar intensity diagram of the light distribution from the light-emitting arrangement of FIG. 4*a*.
Figure 4B:
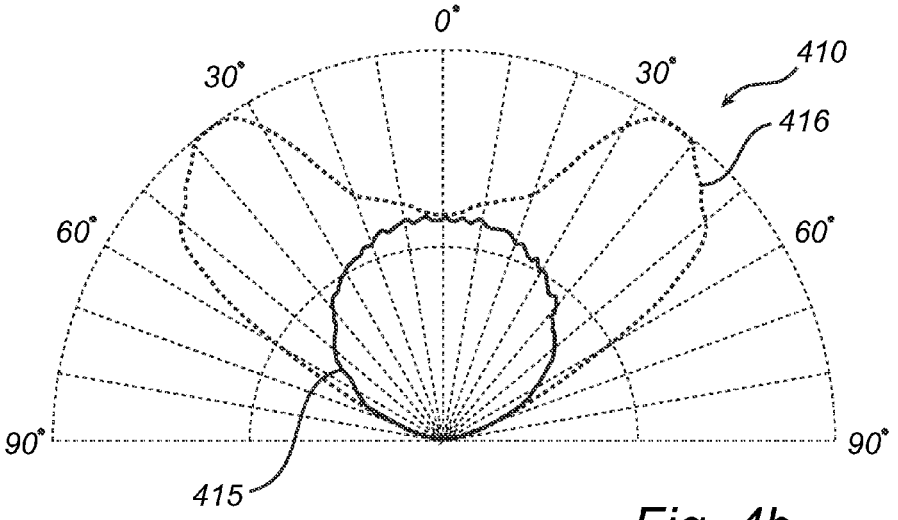

A cross-sectional side view of example embodiment of the light-emitting arrangement 400 of the invention is shown in FIG. 4*a*, where the wavelength converting member 404, arranged at on a PCB 401 having a reflective coating 402, has a top face 405 with a width X2 of 2.50 cm, and a first and a second side face with a width Y2 of 5.00 cm. Furthermore, the first 406 and the second 407 side faces of the wavelength converting member 404 are arranged on a respective side of the LED 403 (on the PCB). The first 412 and the second 413 specular reflectors are each arranged on a respective side of the wavelength converting member 404. Each of the first and the second specular reflectors 412, 413 has a width Y3 of 35.00 cm and is oriented at angle β of 81° with respect to the reflective surface 402 of the PCB 401. The wavelength converting member 404 and the first 412 and the second 413 specular reflectors on the PCB 401 are surrounded by a dome shaped waterproof cover 420 with a width X4 of 85.00 cm and a height Y4 of 44.10 cm. In this example the flux density is 0.4 $lm/mm^2$ and the total emitted flux is 1350 lm. FIG. 4*b* shows the corresponding polar intensity diagram 410 of the light distribution of the light emitted from the light-emitting arrangement 400 in FIG. 4*a*, where the solid line 415 represents the horizontal angle and the dotted line 416 represents the vertical angle. As can be seen in FIG. 4*b*, the light distribution of the light emitted from the light-emitting arrangement 400 of FIG. 4*a* corresponds to a double asymmetric beam shape (or "batwing" shape).

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage.

The invention claimed is:

1. A light-emitting arrangement, comprising:

a reflective member having a reflective surface;

a plurality of light-emitting diodes arranged on said reflective surface of said reflective member along a longitudinal direction with respect to said reflective member, said plurality of light-emitting diodes being adapted to emit light of a first wavelength;

a wavelength converting member comprising a first wavelength converting material adapted to convert light of said first wavelength into light of a second wavelength, said wavelength converting member being arranged on said reflective member and having a top face oriented parallel to said reflective surface of said reflective member, and having a first side face and a second side face each arranged between said top face and said reflective member on a respective side of said plurality of light-emitting diodes, said first and second side faces extending along said longitudinal direction, wherein light is transmitted through said first side face and said second side face, and wherein said top face is arranged at a vertical distance from a light-emitting surface of said plurality of light-emitting diodes; and a first planar specular reflector and a second planar specular reflector arranged on said reflective member on a respective side of said wavelength converting member, wherein said first planar specular reflector is configured to reflect at least a portion of the light transmitted through said first side face out of said light-emitting arrangement and wherein the at least a portion of the light transmitted through said first side face does not pass through said top face;

wherein the top face and at least one of the first or second side face are adapted to convert light of said first wavelength into light of said second wavelength and wherein the reflectivity of said top face is different from the reflectivity of said at least one of the first side face or the second side face;

wherein the top face, the first side face and the second side face are adapted to convert light of said first wavelength into light of said second wavelength and wherein the reflectivity of said top face is different from the reflectivity of said first side face and from the reflectivity of said second side face; wherein the reflectivity of said first side face is different from the reflectivity of said second side face.

2. The light-emitting arrangement according to claim 1, wherein said light-emitting arrangement further comprises a redirecting member arranged in the path of light from at least one light-emitting diode of said plurality of light-emitting diodes to said wavelength converting member, to redirect light emitted by said at least one light-emitting diode towards said wavelength converting member.

3. The light-emitting arrangement according to claim 1, wherein each of said first and second side faces is arranged at a lateral distance from at least one light-emitting diode of said plurality of light-emitting diodes.

4. The light-emitting arrangement according to claim 3, wherein the ratio between a width of each of said first and said second side faces and a width of said top face is in the range of from 100:1 to 1:100.

5. The light-emitting arrangement according to claim 4, wherein each of said first and second side faces of said wavelength converting member is oriented at angle $\alpha$ in the range of 30-150° with respect to said reflective surface of said reflective member.

6. The light-emitting arrangement according to claim 5, wherein said first side face is adapted to have a first reflectivity R1, and said second side face is adapted to have a second reflectivity R2, and said top face is adapted to have a third reflectivity R3, wherein at least one of R1, R2 and R3 is different from another one of R1, R2 and R3.

7. The light-emitting arrangement according to claim 6, wherein all of R1, R2 and R3 reflectivity are different from each other.

8. A luminaire comprising said light-emitting arrangement according to claim 1.

9. The light-emitting arrangement according to claim 2, wherein said redirecting member is disposed on a light-emitting surface of said at least one light-emitting diode.

10. The light-emitting arrangement according to claim 9, wherein said redirecting member is in thermal contact with said at least one light-emitting diode on said reflective member, and with at least one of said first face, said second face and said top face.

11. The light-emitting arrangement according to claim 2, wherein said redirecting member and said at least one light-emitting diode are mutually spaced apart.

12. The light-emitting arrangement according to claim 11, wherein said redirecting member comprises at least one of a diffusing optical element, a refractive optical element, a diffractive optical element and a reflective optical element.

13. The light-emitting arrangement according to claim 12, wherein said wavelength converting member comprises a third side face and a fourth side face arranged between said top face and said reflective member on a respective side of said at least one light-emitting diode, said third and fourth side faces extending from said first side face to said second face along a direction that is transverse to said longitudinal direction.

* * * * *